US006152119A

United States Patent [19]

Hoshiba et al.

[11] Patent Number: 6,152,119

[45] Date of Patent: Nov. 28, 2000

[54] OIL SEPARATOR FOR FOUR-CYCLE OUTBOARD MOTOR

[75] Inventors: Akihoko Hoshiba; Takahide Watanabe, both of Hamamatsu, Japan

[73] Assignee: Sanshin Kogyo Kabushiki Kaisha, Japan

[21] Appl. No.: 09/299,765

[22] Filed: Apr. 26, 1999

[30] Foreign Application Priority Data

Apr. 24, 1998 [JP] Japan ..... 10-114697

[51] Int. Cl.[7] ..... F02B 25/06

[52] U.S. Cl. ..... 123/572

[58] Field of Search ..... 123/572, 573, 123/574, 41.86

[56] References Cited

U.S. PATENT DOCUMENTS 4,790,287 12/1988 Sakurai et al. .
5,035,207 7/1991 Sakurai et al. .
5,329,913 7/1994 Suzuki et al. .
5,501,190 3/1996 Okubo et al. .
5,501,202 3/1996 Watanabe .
5,514,015 5/1996 Okazawa et al. .
5,537,959 7/1996 Ito .
5,564,380 10/1996 Kobayashi et al. .
5,687,686 11/1997 Takahashi .
5,752,866 5/1998 Takahashi et al. .
5,782,217 7/1998 Ito et al. .
5,794,602 8/1998 Kimura .
5,899,197 5/1999 Watanabe et al. .
5,996,561 12/1999 Watanabe ..... 123/572

*Primary Examiner*—Marguerite McMahon
*Attorney, Agent, or Firm*—Knobbe, Martens, Olson & Bear, LLP

[57] ABSTRACT

A four-cycle outboard motor has an oil separator positioned within a head cover assembly. The oil separator is positioned within a recess of a cam cover, which forms a portion of the head cover assembly. A cover plate is interposed between the oil separator and a cam chamber. The oil separator includes a generally u-shaped labyrinth through which exhaust gases with entrained lubricant are sucked. A suction portion extends through the cover plate and facilitates communication between the cam chamber and the oil separator. An exhaust return line is connected to an induction system to draw gases through the oil separator back into the induction system.

27 Claims, 9 Drawing Sheets

OIL SEPARATOR FOR FOUR-CYCLE OUTBOARD MOTOR

BACKGROUND OF THE INVENTION

1. Field of the Invention

The present invention relates to an internal combustion engine. More particularly, the present invention relates to an oil separator for a four-cycle vertically-oriented engine.

2. Description of the Related Art

Internal combustion engines operating on a four-cycle principle may be provided with a pressure lubricating system for lubricating various engine components. In such engines, it is advantageous to provide a ventilating arrangement whereby the lubricant contained within a crankcase, oil pan and cam chamber may be ventilated to retard deterioration of the lubricant and to remove some of the contaminants from the lubricant. In some engines, a ventilating air source for the ventilation arrangement includes blow-by gases that may escape from the combustion chamber through the cylinder, past the piston, and into the crankcase.

Once present within the crankcase, the blow-by gases are circulated within portions of the lubrication system to ventilate the lubricant. As the blow-by gases pass through the lubrication system, lubricant may become entrained within the blow-by gases and be passed to the atmosphere as the blow-by gases are vented to the atmosphere through an outlet for the crankcase venting arrangement. Alternatively, the entrained lubricant may be cycled back through the induction system and into the combustion chamber for combustion with the air fuel charge. In either scenario, an undesirable level of hydrocarbon emissions may be conveyed to the atmosphere.

By positioning an outlet for the ventilating gases at a position outside of the crankcase, increased circulation of the ventilating gases may be obtained. Additionally, such positioning may allow for an increased vertical separation between the outlet and the lubricant pooling within a lubricant pan to ease the withdrawl of the ventilating air. For instance, positioning an outlet for the ventilating gases within a cam chamber would encourage the gases to pass from the crankcase into the cam chamber and increase the circulation path of the gases. Such movement of the gases, however, tends to oppose the movement of the lubricant and may result in additional lubricant becoming entrained within the ventilating air.

Accordingly, oil separators may be employed to remove some of the lubricant from the ventilating air prior to emission to the atmosphere or cycling through the induction system. In some engines, oil separators may be positioned external to the engine or abutting upon a wall of a head cover of the engine with an outlet duct positioned external to the crankcase in order to maintain the ventilation arrangement's outlet positioning. In engines featuring external oil separators, the provision of a separator component apart from the engine results in added complexity, weight, cost and bulk. Similarly, in engines featuring an adjoining oil separator, the number of parts is increased and the connection between the oil separator and the engine adds several assembly and maintenance difficulties. For instance, the juncture between the oil separator and the engine must be sealed, which adds components and, accordingly, weight to the engine. Moreover, the assembly becomes more difficult and costly due to the increase in parts. As will be recognized, the seal also may deteriorate over time, requiring replacement or maintenance to ensure proper oil separator and engine performance.

SUMMARY OF THE INVENTION

Therefore, a compact arrangement for an oil separator is desired. The arrangement should reduce weight and number of components. Additionally, the arrangement should reduce necessary maintenance over the life of the engine.

Accordingly, one aspect of the present invention involves an outboard motor comprising an engine. The engine has a cylinder block with at least one cylinder. The cylinder preferably has a substantially horizontal axis and a piston arranged for reciprocation within the cylinder. The cylinder is connected to an output shaft having a substantially vertical axis. A head assembly is connected to the cylinder block with at least one combustion chamber being defined between the head assembly and a piston. At least one intake port and at least one exhaust port are in communication with the combustion chamber. An intake valve is capable of closing and opening the intake port while an exhaust valve is capable of closing and opening the exhaust port. An intake camshaft is capable of moving the intake valves while an exhaust camshaft is capable of moving the exhaust valves. A head cover may be positioned over the intake camshaft and the exhaust camshaft to define, in part, a cam chamber. An oil separator is positioned within the cam chamber. A cover plate may be interposed between the oil separator and the cam chamber such that the oil separator may be separated from the cam chamber.

According to another aspect of the present invention, an outboard motor comprises a generally vertically oriented engine. The engine comprises a generally vertically-oriented camshaft and crankshaft. A camshaft cover defines, in part, a camshaft chamber with the camshaft chamber substantially enveloping at least a portion of the camshaft. The engine also has an oil separator with a cover plate positioned between the oil separator and the camshaft chamber. The oil separator preferably has a suction port defined within the cover plate. A shielding member defining an intake chamber is positioned on the cam chamber side of the cover plate with the suction port extending in a first direction into the intake chamber and an opening defined within the shielding member that extends in a second direction not aligned with the first direction.

BRIEF DESCRIPTION OF THE DRAWINGS

These and other features, aspects and advantages of the present invention will now be described with reference to the drawings of a presently preferred embodiment, which embodiment is intended to illustrate and not to limit the invention, and in which figures.

DETAILED DESCRIPTION OF THE PREFERRED EMBODIMENT

Figure 1:
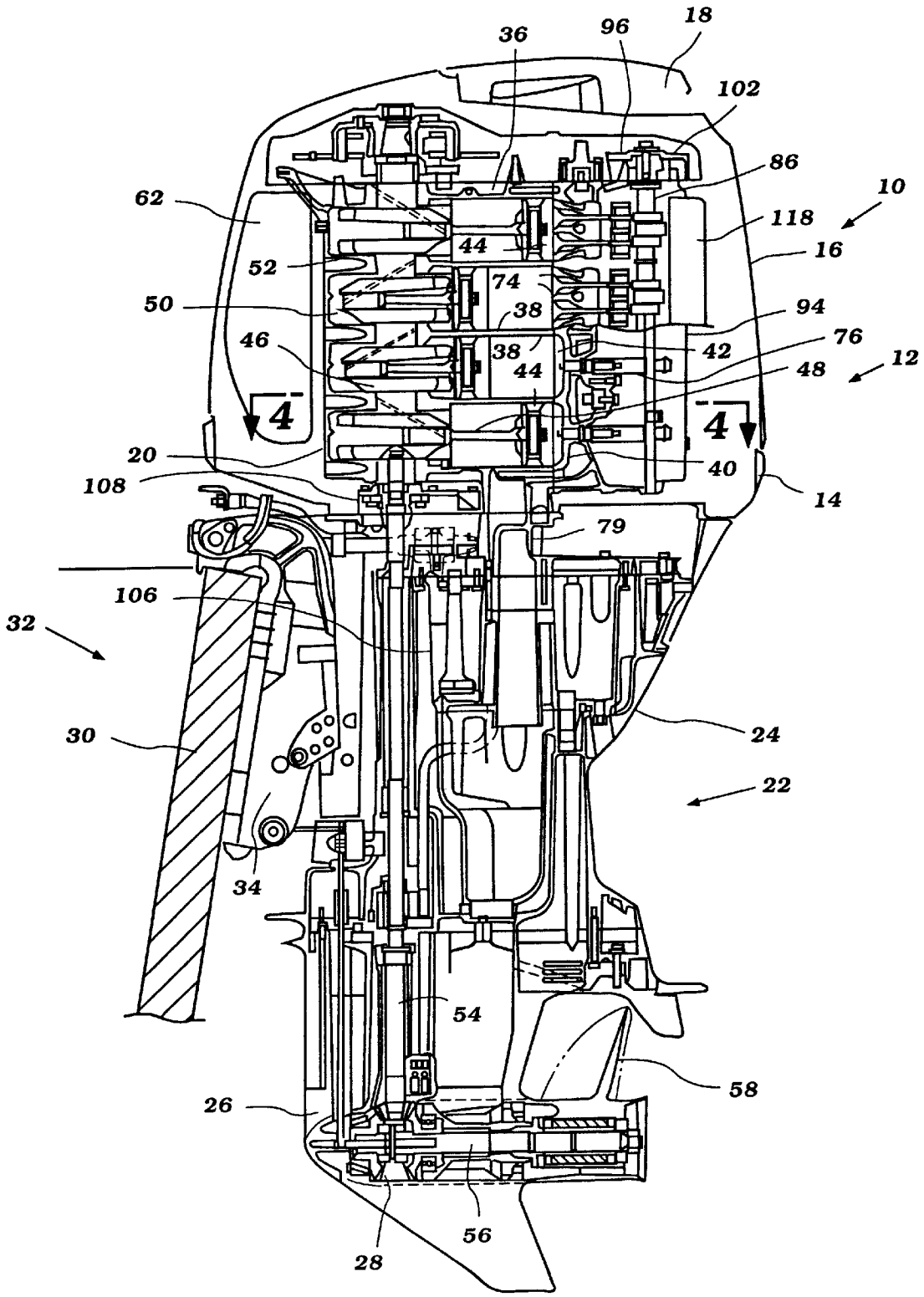
FIG. 1 is a partially-sectioned side view of an outboard motor of the type which may be powered by an engine having an oil separator configured and arranged in accordance with certain aspects of the present invention.

With initial reference to FIG. 1, an outboard motor having an oil separator configured and arranged in accordance with certain features, aspects and advantages of the present invention is illustrated therein. The outboard motor is indicated generally by the reference numeral 10. While the present oil separator is described in the context of an outboard motor for watercraft, it should be appreciated that the lubrication system may also find utility in other internal combustion engine applications having at least one substantially-inclined or vertically oriented shaft requiring lubrication.

The illustrated outboard motor 10 has a power head area 12 comprised of a lower tray portion 14 and an upper cowling portion 16. The lower tray portion 14 and the upper cowling portion 16 may be joined in a well-known manner such that the power head area 12 is substantially weatherproof and water spray resistant. For instance, a rubber seal (not shown) may be positioned in the joining region. An air vent or air inlet area 18 is provided in the illustrated upper cowling portion 16 for providing air to an engine 20 that is desirably arranged and encased within the power head area 12. The air vent 18 also allows heated air to be exhausted from within the power head area 12.

With continued reference to FIG. 1, the illustrated outboard motor 10 also includes a lower unit 22 extending downwardly from the lower tray portion 14 of the power head area 12. The lower unit 22 generally comprises an upper or drive shaft housing portion 24 and a lower portion 26 which contains a transmission 28 and carries a propulsion mechanism described below.

The illustrated outboard motor is generally attached to a transom 30 of a watercraft 32 by a bracket 34 as is well known in the art. This bracket 34 preferably enables both steering and tilt and trim such that the outboard motor 10 may be steered about a substantially vertical axis and tilted or trimmed about a substantially horizontal axis in manners well known to those skilled in the relevant art.

With continued reference to FIG. 1, the engine 20 may be of any configuration that is substantially inclined such that an axis of at least one camshaft or crankshaft has an inclined or substantially vertical axis. For instance, the engine may contain as few as one cylinder or more than two cylinders. In the illustrated embodiment, the engine comprises four inline cylinders. The engine 20 may also operate on any known operating principle. The illustrated engine preferably operates on a four-cycle principle.

Accordingly, the illustrated engine 20 generally comprises a cylinder block 36 that contains four inline cylinders 38 which are closed by a cylinder head assembly 40 to create a combustion chamber 42 above a piston 44 within each of the cylinders 38. The piston 44 is arranged for reciprocation within the cylinder 38 and connected to a crankshaft 46 via connecting rods 48 in a known manner. Each of these elements are well known by those of skill in the art and their manufacturing and assembly methods are also well known.

The crankshaft 46 is preferably rotatably journaled within a crankcase chamber 50. The illustrated crankshaft chamber 50 is defined in part by a crankcase cover 52. As is typical with outboard motor practice, the engine 20 is preferably mounted in the power head 12 so that the crankshaft 46 rotates about a substantially vertically extending axis. This positioning facilitates coupling to a driveshaft 54 in any suitable manner.

The driveshaft 54 depends into the lower unit 22 wherein it drives a bevelled gear in conventional forward, neutral, reverse transmission 28. Any known type of transmission may be employed. Moreover, a control is preferably provided for allowing an operator to remotely control the transmission 28 from within the watercraft 32.

The transmission 28 desirably drives a propeller shaft 56, which is rotatably journaled within the lower portion 26 of the lower unit 22 in a known manner. A hub of a propeller 58 is coupled to the propeller shaft 56 for providing a propulsive force to the watercraft 32 in a manner also well known to those of ordinary skill in the art.

Figure 2:
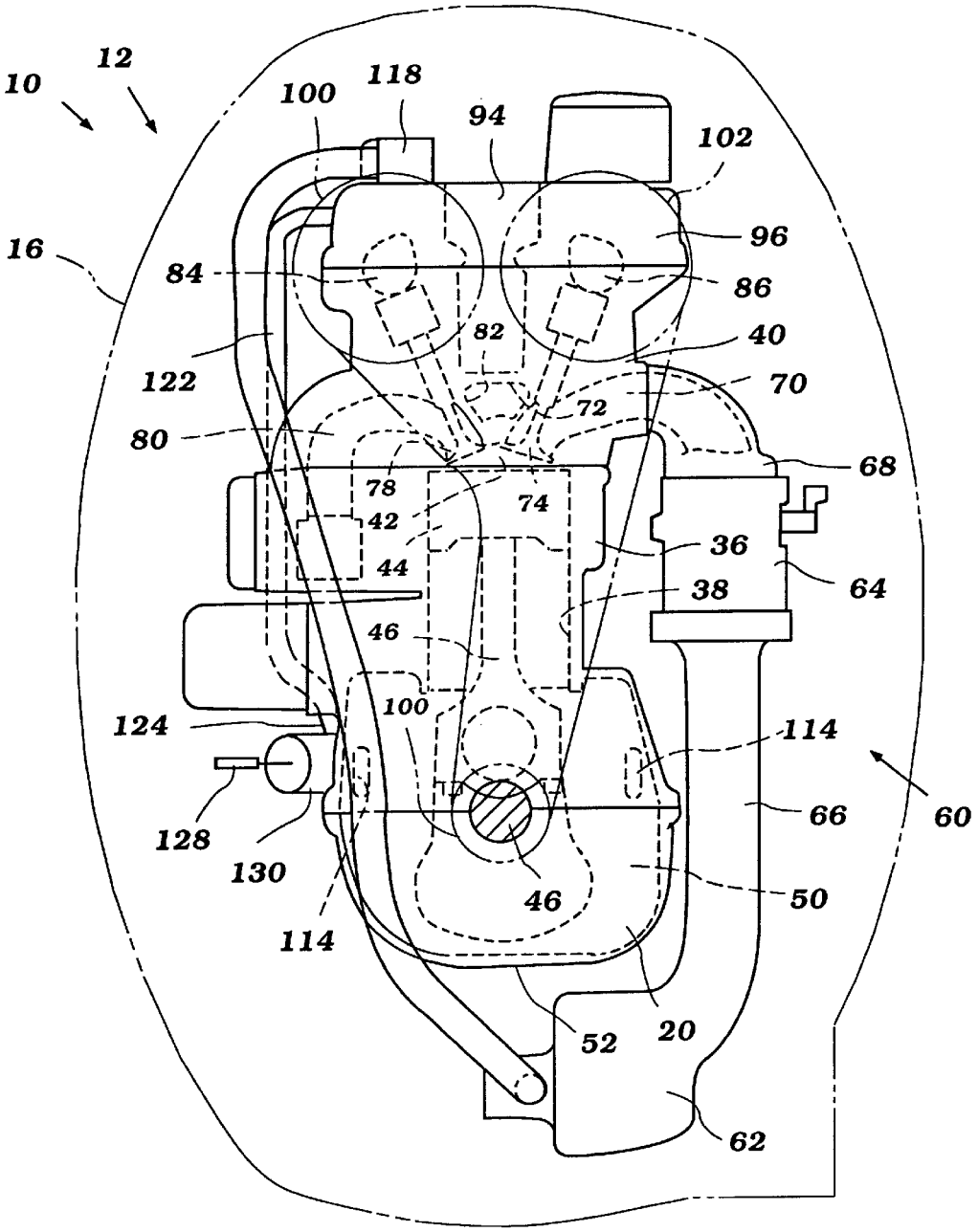
FIG. 2 is a top view of the outboard motor of FIG. 1 with certain components illustrated with phantom lines and certain other components illustrated with hidden lines.

With reference now to FIG. 2, the illustrated engine 20 is provided with an intake system 60. The intake system 60 transfers air from outside of the outboard motor upper cowling 16 to the combustion chambers 42. Specifically, the air from outside of the upper cowling 16 is drawn into the cowling through the air vent 18. This air is then pulled into a silencer 62 through an intake opening 63. The intake opening 63 may be provided with a filter or grate such that airborne particles can be filtered from the air prior to introduction into the engine 20.

The air is then transferred from the silencer 62 to a carburetor 64 through an intake pipe 66. As illustrated in FIG. 2, the intake pipe 66 wraps around the side of the engine 20 and extends rearward toward the carburetor 64. While the illustrated engine 20 is a carbureted engine, it is anticipated that the present invention may also have utility with a fuel-injected engine of either the direct injection or indirect injection type. Fuel is introduced to the airflow of the induction system 60 within the carburetor 64 in a known manner. Moreover, a throttle valve is typically positioned within or immediately adjacent the carburetor 64 for controlling the rate of airflow into the combustion chamber through the intake system 60.

The air flows from the carburetor 64 into an intake manifold 68. The illustrated intake manifold 68 generally comprises a plurality of runners such that each cylinder is supplied with an air/fuel charge through an individual runner. The air continues from each runner of the illustrated intake manifold 68 through a corresponding intake passage 70 through which the air is introduced into the combustion chamber 44 in a known manner. The intake passage 70 joins with the combustion chamber 44 at an intake port 72 also in a known manner.

The introduction of the air fuel charge into the combustion chamber 44 is controlled by an intake control valve 74 such that the timing and duration of the induction of the air fuel charge may be controlled as desired. The intake control valve 74 is actuated in a manner to be described below.

Upon introduction into the combustion chamber, during an intake stroke of the piston 44, the intake control valve 74 generally closes as soon as, or just before, the piston 44 begins its compression stroke. The compressed air fuel charge is then ignited by a spark plug 76 which has an electrode positioned within the combustion chamber region for igniting the air fuel charge.

Figure 3:
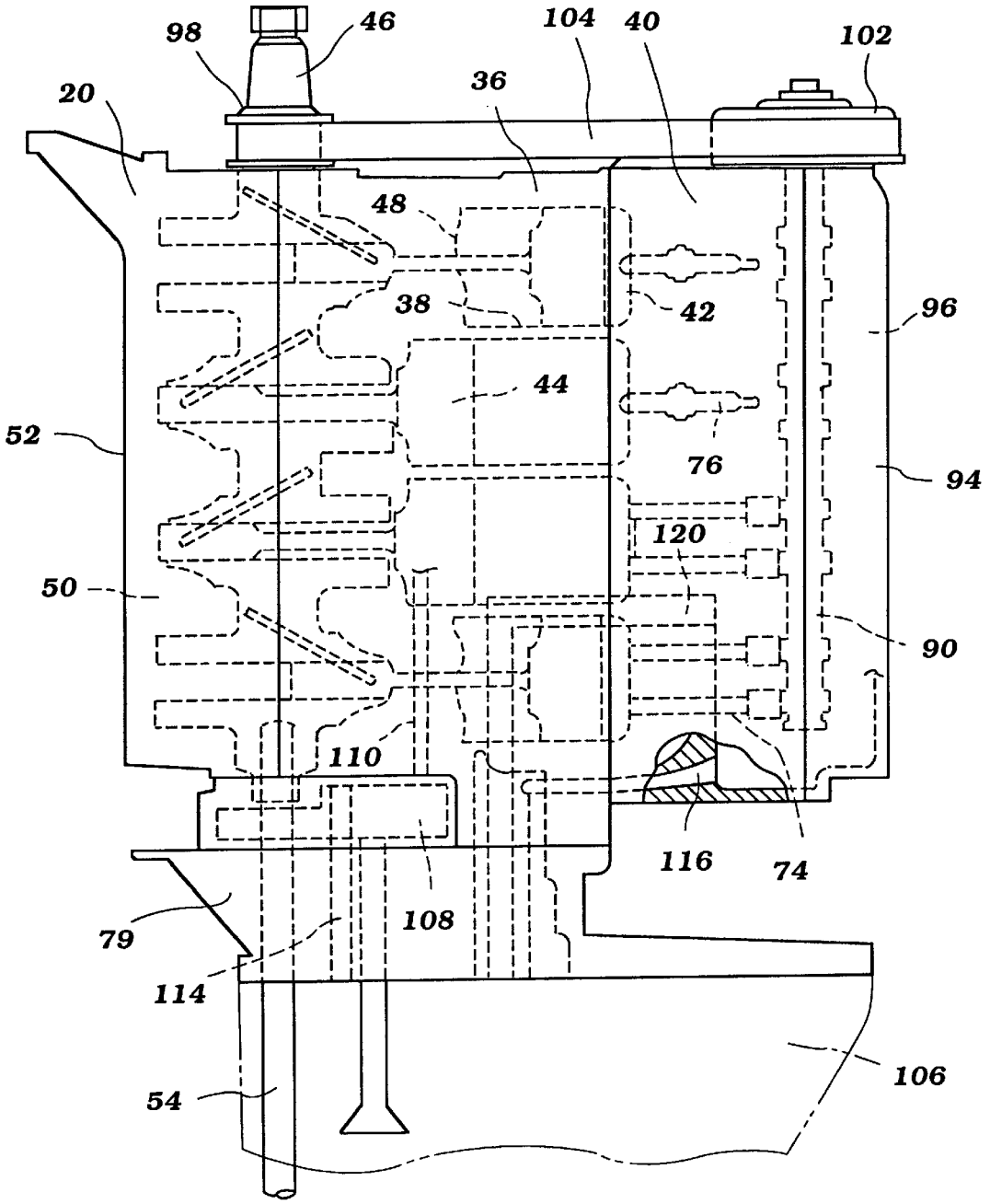
FIG. 3 is a partially-sectioned side view of a portion of the outboard motor of FIG. 1 illustrating a portion of a lubrication system featuring an oil separator configured and arranged in accordance with certain aspects of the present invention.

An exhaust system is provided for routing the products of the combustion within the combustion chamber 42 to a point external to the engine 20. In particular, the exhaust gases pass through an exhaust port 78 in the combustion chamber 42 and are routed via an exhaust passage 80 to an exhaust manifold. In the illustrated engine, an exhaust guide plate 79 is positioned below the cylinder block 36 as best shown in FIG. 3. The exhaust guide plate 79 guides the exhaust gases into the balance of the exhaust system which extends downward into the lower unit to an outlet positioned proximate the propeller 58. Because the balance of the exhaust system is considered well known to those of skill in the art, such components will not be further described herein.

As will be recognized by those of skill in the art, the exhaust flow through the exhaust port 78 may be controlled by an exhaust control valve 82 such that the timing and duration of the exhaust flow from the combustion chamber 42 may be controlled as desired. The exhaust control valve 82 may be manipulated in a manner to be described below.

As those of skill in the art also will recognize, some of the exhaust gases created within the combustion chamber 42 during ignition may blow past the piston 44 and the piston rings (not shown) either deliberately or unintentionally. These gases, generally referred to as blow-by gases, eventually escape into the lubrication system rather than flowing to the atmosphere through the exhaust system. The lubrication system, accordingly, is provided with a venting arrangement, which will be described in detail below.

As introduced above, the movements of the intake control valves 74 and the exhaust control valves 82 are desirably controlled such that the timing and duration of the intake and exhaust flows respectively may be controlled. With reference to FIG. 2, the illustrated exhaust control valve 82 and the illustrated intake control valve 74 are controlled by respective camshafts. Specifically, an exhaust control valve camshaft 84 preferably controls the opening and closing of the exhaust port 78 in a manner well known to those of ordinary skill in the art. Similarly, an intake control valve camshaft 86 controls the opening of the illustrated intake port 72 in a manner well known to those of ordinary skill in the art.

Both the intake camshaft 86 and the exhaust camshaft 84 are mounted for rotation with respect to the cylinder head assembly 40 and are connected thereto with at least one bracket or bearing, not shown. The camshafts 84, 86 are enclosed by camshaft covers 88 and 90, respectively. The covers 88,90 define, in part, an exhaust cam chamber 89 and an intake cam chamber 91. Both covers are desirably individually connected to the cylinder head assembly 40. Together, the exhaust cam cover 88, the intake cam cover 90 and a connection cover 92 combine to form a head cover arrangement 94. The connection cover 92 also includes a connecting passage 93, illustrated best in FIG. 8. An area defined between the head cover 94 and the cylinder head assembly 40 is referred to herein as a cam chamber 96. Each of the camshafts 84, 86 is contained within its own cam chamber in the illustrated embodiment but need not be. The cam cover 90 also includes openings such as an oil fill aperture 200 and fuel pump drive shaft apertures 202 but these openings 200,202 may be positioned in any suitable manner.

Figure 5:
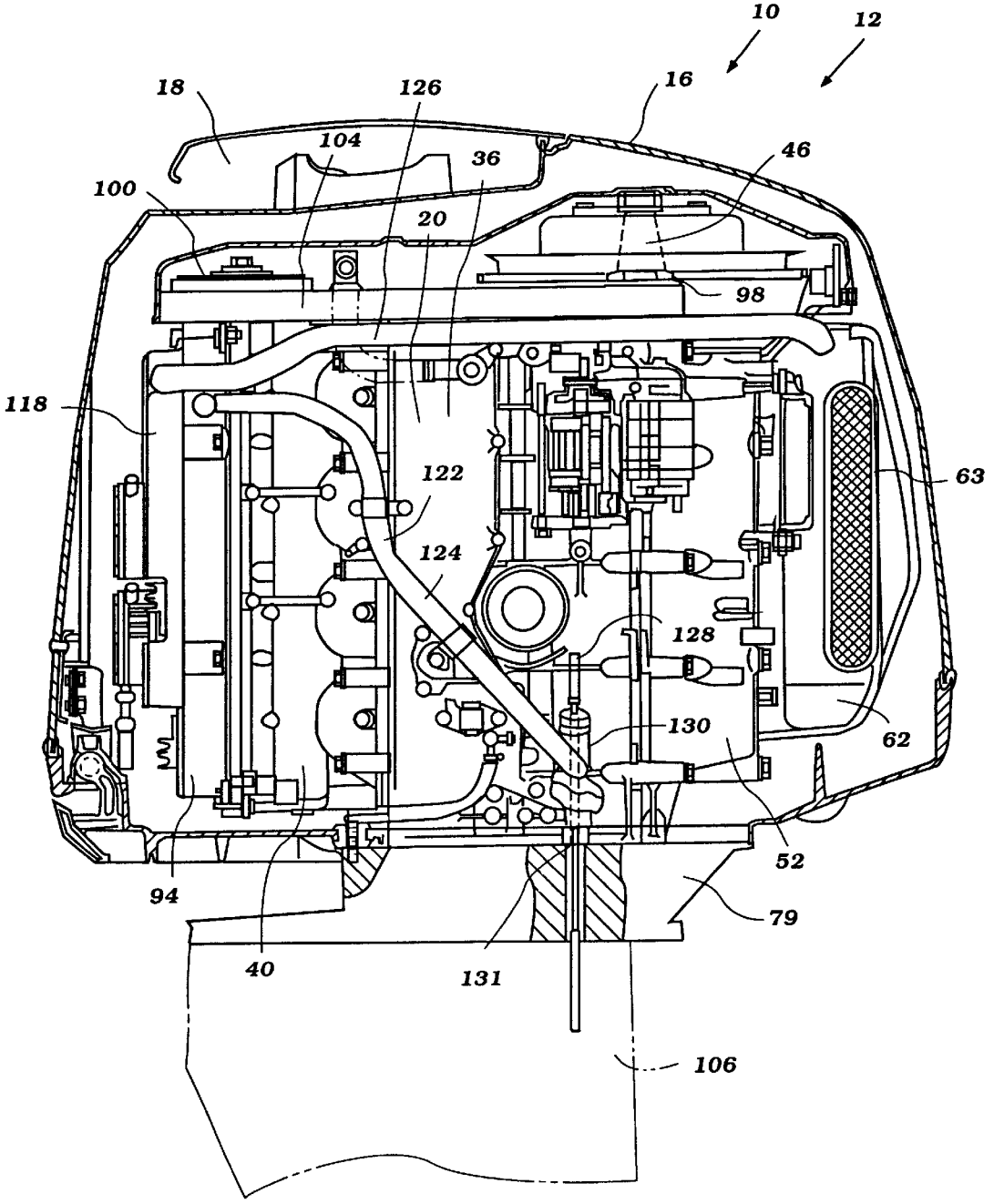
FIG. 5 is a partially-sectioned side view of a portion of the outboard motor of FIG. 1 illustrating external gas pipes.

With reference now to FIGS. 2, 3 and 5, the exhaust camshaft 84 and the intake camshaft 86 are rotatably driven by a pulley arrangement in the illustrated embodiment. Specifically, a drive pulley 98 is mounted to one end of the crankshaft 46 such that rotation of the crankshaft 46 results in rotation of the drive pulley 98. In the illustrated embodiment, the drive pulley 98 is attached to the upper end of the crankshaft 46 as illustrated in FIG. 3. Each camshaft 84, 86 is provided with a respective driven pulley 100, 102. The relative diameters of each of the pulleys 98, 100, 102 are selected for desired performance.

A drive belt 104 loops around both driven pulleys 100, 102 and preferably has an idler pulley arranged along its length at a desirable location to maintain a tension such that as the drive pulley 98 spins, it may drive the driven pulleys 100, 102 and rotate the respective camshafts 84, 86. As the driven pulley 100 spins, the camshaft 84 rotates on bearings (not shown), thereby moving the exhaust control valves 82, which are desirably biased in an open position, through the lobe construction of the camshafts 84, 86, which construction is well known by those of ordinary skill in the art. Similarly, as the driven pulley 102 rotates, the intake camshaft 86 also drives the intake control valve 74 in a similar manner.

The present outboard motor 10 also includes a lubrication system configured and arranged in accordance with certain aspects, features and advantages of the present invention. Specifically, with initial reference to FIG. 1, the lubrication system has a lubrication pan 106 mounted within the driveshaft housing portion 24 of the lower unit 22. The lubrication pan 106 is desirably the lowest point in the lubrication system, such that the lubricant may drain from the engine components being lubricated back into the lubrication pan 106. The lubrication pan 106 may have any known size, shape or configuration and may be mounted to the engine in any suitable manner.

With reference to FIGS. 1 and 3, a lubrication pump 108 is desirably driven by either the crankshaft or the driveshaft 54, such that an auxiliary driving arrangement is not required, nor is a secondary electric motor required for those lubrication systems configured in accordance with the illustrated embodiment. As best illustrated in FIG. 3, the lubrication pump 108 is desirably mounted above the exhaust guide 79 and has an intake port extended down into the lubrication pan 106. The illustrated lubrication pump 108 preferably draws lubrication fluid, such as oil, for instance, from a pick-up disposed within a lower portion of the lubrication pan 106 and expels it into a lubrication passage 110. As will be appreciated by those of ordinary skill in the art, the pick-up may include a filter or screening element such that debris and foreign particles may be removed prior to the lubricant being sprayed onto the moving components of the engine 20.

Figure 4:
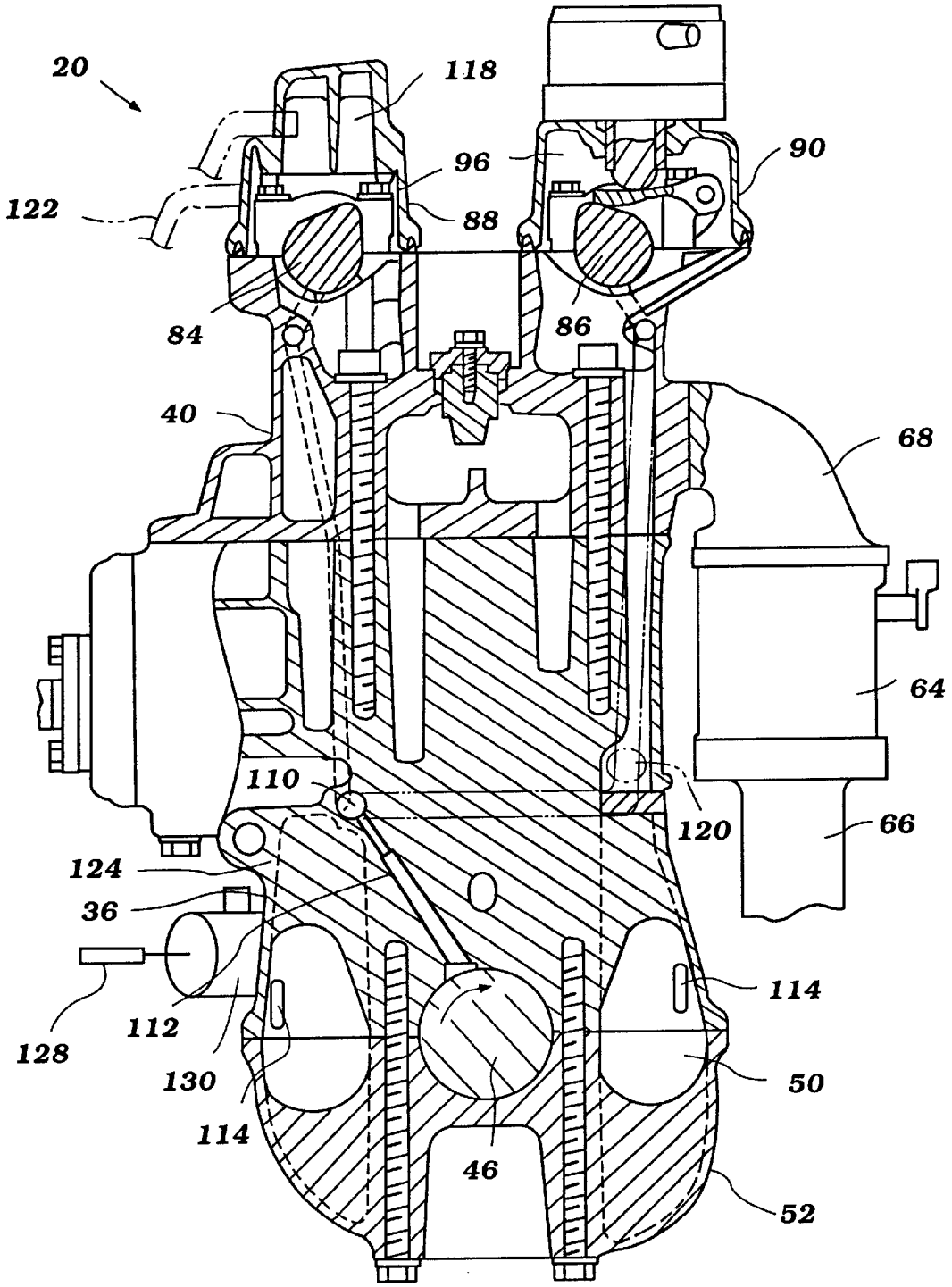
FIG. 4 is a partially-sectioned top view of the engine of FIG. 1 taken along the line 4—4.

With reference to FIG. 4, the lubrication passage 110 extends upward through the cylinder block 36 until it reaches an upper portion of the cylinder block 36. The lubrication passage 110 extends to the intake camshaft 86 and the exhaust camshaft 84 in order to supply lubrication to the camshafts respectively. The lubrication passage 110 also extends upward to connect to a crankshaft lubrication passage 112. As is known, the lubrication provided to the camshafts 84, 86 and the crankshaft 46 is expelled at various locations through secondary lubrication galleries such that the lubricant will lubricate the bearing surfaces and drain downward under the force of gravity to pool in a lower region of the crankcase chamber and camshaft chamber, respectively.

With continued reference to FIG. 4, a pair of return passages 114 are illustrated through which lubrication pooling in the lower portion of the chamber 50 may be returned to the lubrication pan 106. These return passages are best illustrated in FIG. 3, which shows how the return passages 114 extend downward through the exhaust guide. The illustrated return passages 114 simply extend through a floor portion of the crankcase chamber 50 and empty into the lubrication pan 106.

With reference again to FIG. 3, a camshaft lubricant return passage 116 is also shown extending through the cylinder block 36. The lubricant return passage 116 has an inlet that is desirably vertically lower than the lowest control valve. In some embodiments, the lubricant return passage may have an inlet which is at approximately the same vertical position as the lower control valve 74, 82.

As described above, the illustrated lubricant pump 108 forcibly delivers lubrication through the lubrication passage 110 to an upper portion of both the intake camshaft 86 and the exhaust camshaft 84. This lubrication will be drawn downward along the camshaft within the cam chamber 96 under gravity into a pool near the bottom of the cam chamber 96. From this pooling position, the lubricant may be returned to the lubrication pan 106 through the camshaft lubrication return passage 116. As will be recognized by those of ordinary skill in the art, two lubrication return passages 116 are featured in the illustrated embodiment; however, more than two such return passageways may be utilized.

The illustrated lubrication return passages 116 feature a substantially horizontal portion having a fluted opening which is wider at its inlet and decreasing in diameter to its outlet. The outlet of the substantially horizontal portion empties into an enlarged substantially vertical portion. As shown in FIG. 3, the two portions join such that the horizontal portion is spaced vertically lower than an upper most portion of the vertical portion. Moreover, the horizontal portion has a slight downward slope to encourage downward flow when the engine is not operating. The horizontal portion is also extending in a generally forward direction. Accordingly, as the engine is tilted, flow through the passage is encouraged and, due to the slight downward slope of the horizontal portion, flow is still encouraged even when the outboard motor 10 is positioned in a slightly trimmed condition.

With reference now to FIGS. 1 and 8 through 13, an oil separator 118 is provided along the camshaft chamber 96. In the illustrated embodiment, the oil separator 118 is positioned within the camshaft chamber 96 such that it is positioned within a recess in the head cover arrangement 94. The blow-by gases usually contain hydrocarbons and oil or lubricant particles that are picked up as the blow-by gases travel through the lubrication system. Hence, it is advantageous to have an oil separator 118 which is capable of separating the gas flow from the lubricant and thereby is capable of reducing the emission of lubricant by the engine. Moreover, such an arrangement may retard the depletion of the lubricant supply. The oil separator 118, described in more detail below, effectively strains the lubricant from the blow-by gases as they are expelled from the camshaft chambers 96.

With reference to FIG. 3, a first gas passageway 120 is defined within the cylinder block 36 and extends between the lubrication pan 106 and the cam chamber 96. As illustrated in FIG. 3, the first gas passageway 120 is separate and distinct from the camshaft lubrication return passage 116. Moreover, the first gas passageway 120 terminates within the cam chamber 96 at a location vertically higher than the inlet to the camshaft lubrication return passage 116. As illustrated, the first gas passageway 120 extends upward through the guide plate 79 into the cylinder block 36. The passageway 120 continues upward to a dogleg toward the camshaft chamber 96. The cross-sectional area of the passageway 120 is preferably approximately the same size as the upper portion of the substantially vertical component of the return passage 116. Even more preferably, the passageway 120 is larger than the smallest portion of the return passage 116. The passageway 120 also preferably opens into the chamber 96 at a position the same as or vertically higher than the lowest control valve 74, 82. While the passageway 120 may open into the chamber 96 at any position, the passageway preferably opens into the chamber below the fourth cylinder. More preferably, the passageway 120 opens into the chamber 96 below the third cylinder. In one embodiment, the passageway 120 opens into the chamber 96 between the first and second cylinders.

Figure 6:
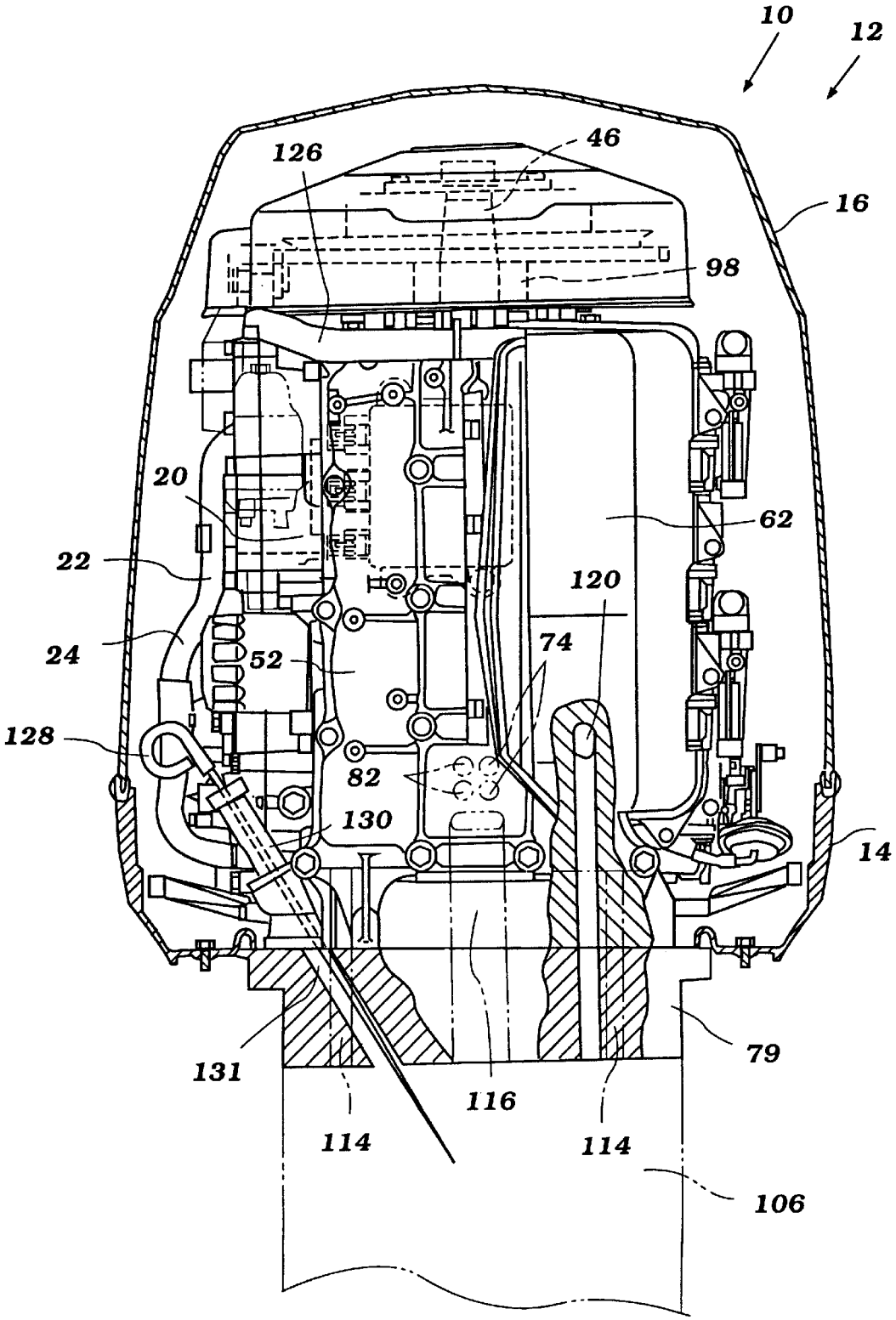
FIG. 6 is a partially-sectioned boat side view of the outboard motor of FIG. 1 illustrating the gas pipes of FIG. 5.
Figure 8:
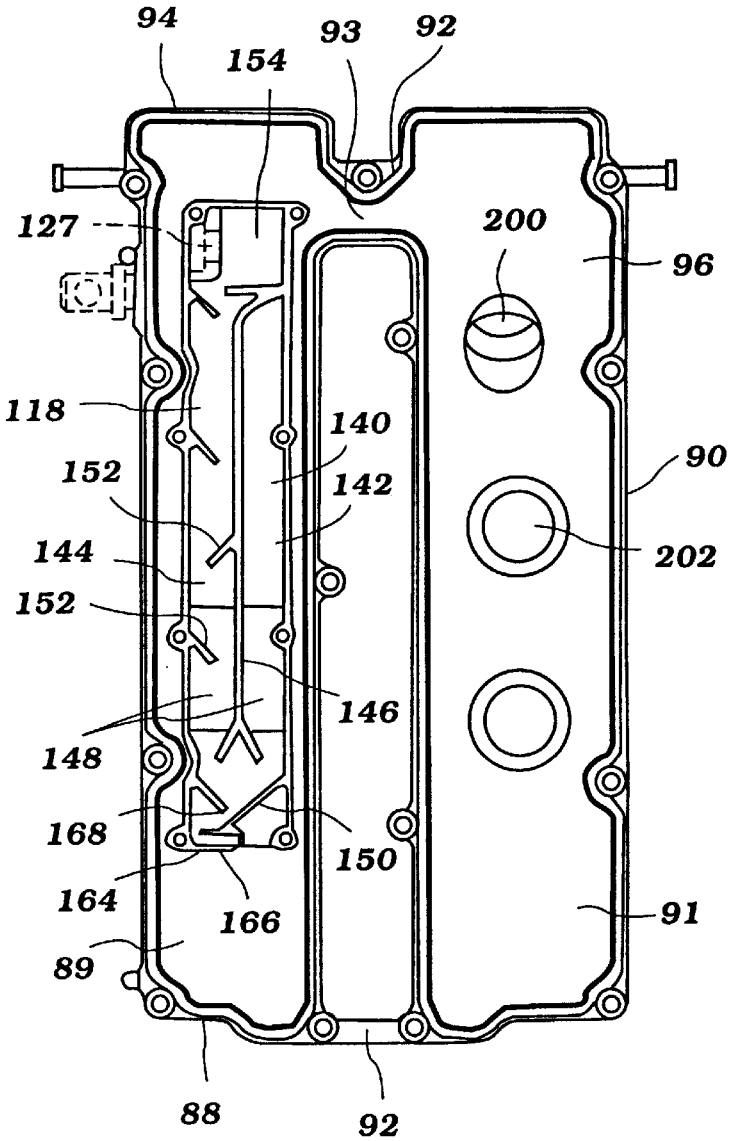
FIG. 8 is front side view of an assembled head cover arrangement featuring a portion of an oil separator configured and arranged in accordance with certain aspects of the present invention.

With reference now to FIG. 6, a second gas passageway, which is also in communication with the lubrication pan 106, extends external to the cylinder block 36 through a gas pipe 124. With reference to FIG. 2, the illustrated gas pipe 124 extends generally upward and rearward along one side of the engine 20 and transfers blow-by gases from within the lubrication pan 106 to the cam chamber proximate the oil separator 118, as better illustrated in FIG. 5. With reference to FIG. 8, the gas pipe 124 is connected to the cam chamber proximate the oil separator 118 with an inlet nipple 125. The illustrated gas pipe 124 includes a substantially vertically extending portion such that some of the entrained lubricant may return downward through the gas pipe 124 back into the lubricant reservoir 106. The gas pipe 124 extends upwardly and rearwardly towards the head cover 94 and the oil separator 118, whereby any lubrication particles being transferred therewith can be separated out by the force of gravity such that they may drain back into the lubrication pan 106.

Figure 7:
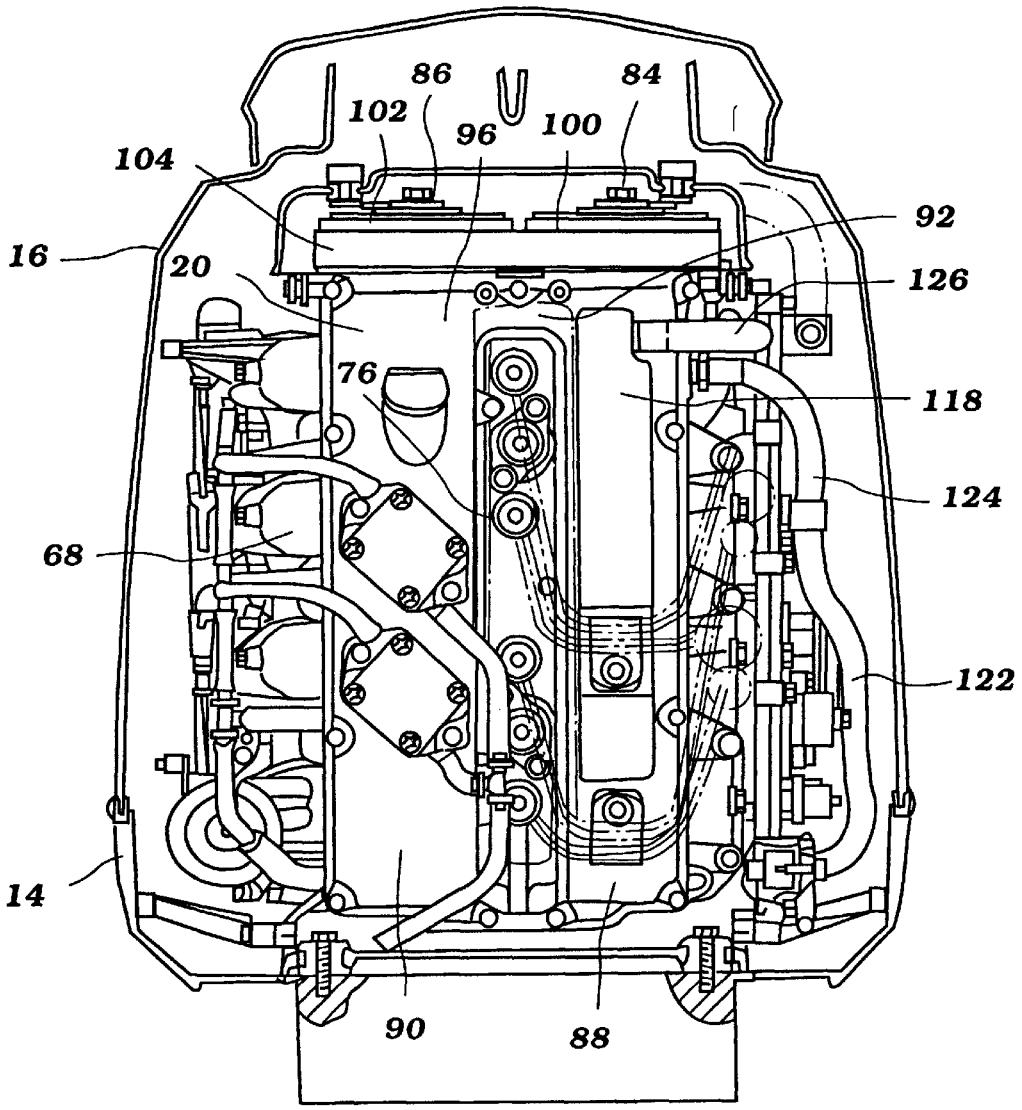
FIG. 7 is a partially-sectioned aft side view of the outboard motor of FIG. 1, further illustrating the gas pipes of FIG. 5 and a head cover arrangement configured and arranged in accordance with certain aspects of the present invention.

The blow-by gases, which have had at least a portion of the lubricant extracted therefrom as described below, are then removed from the oil separator 118 via a second gas pipe 126. As best illustrated in FIG. 5, the second gas pipe 126 extends between an upper portion of the oil separator 118 and an upper portion of the air intake silencer 62. With reference to FIGS. 7 and 8, the illustrated gas pipe 126 is connected to the head cover through the outlet port 127. Through the connection to the intake silencer 62, the blow-by gases being siphoned from the oil separator 118 are likely have the greatest amount of lubricant removed therefrom due to the suctioned removal from an uppermost portion of the oil separator. The blow-by gases transferred through the gas pipe 126 into the induction silencer 62 may then be recycled back through the intake system 60 for recombustion when combined with fresh air and fuel charges.

With reference to FIGS. 2, 4 and 6, the illustrated lubrication system is also provided with a ullage rod 128 which extends through a cylindrical tubular member 130 and an internal passageway 131 such that a portion of the ullage rod 128 is received within the lubrication pan 106. This arrangement is best illustrated in FIG. 5. In this manner, the ullage rod 128 may be withdrawn from the tubular member 130 and passageway 131 to identify whether a lubrication level within the lubrication pan 106 has decreased to a level indicating that the lubricant needs to be replenished. Additionally, this ullage rod 128 allows periodic confirmation that the lubricant is not being depleted due to the effects of the blow-by gases on the lubrication system. Notably, the tubular member 130 is positioned near the first end of the second gas passageway 122 (i.e., the first gas pipe 124) such that the second gas passageway 122 may be coupled to the tubular member 130 to allow the gases present within the lubrication pan to escape therethrough into the first gas passageway.

Figure 9:
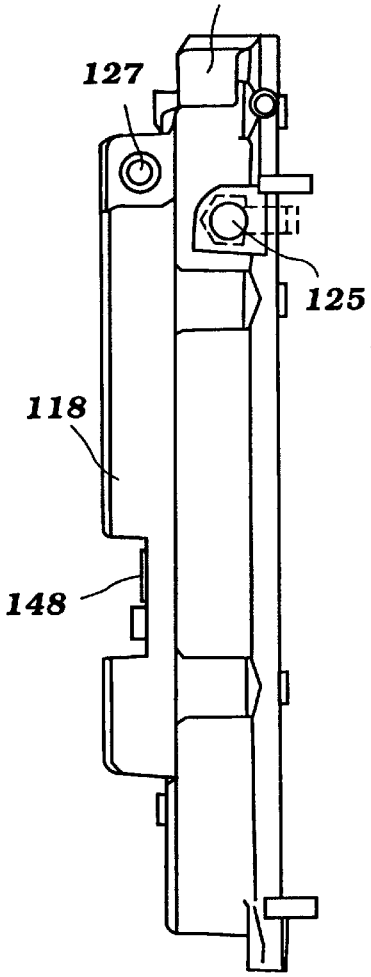
FIG. 9 is a left-side view of an assembled head cover arrangement featuring a portion of an oil separator configured and arranged in accordance with certain aspects of the present invention.

With reference now to FIGS. 8 through 13, an oil separator 118 configured and arranged in accordance with certain features, aspects and advantages of the present invention will be described in detail. With reference initially to FIGS. 8 and 9, the illustrated oil separator 118 is positioned within a recess in the cam cover 96. In the illustrated embodiment, the oil separator 118 is positioned within a recess, or oil separator chamber 140, that is positioned within the exhaust cam chamber 89. With reference especially to FIG. 9, the oil separator chamber 140 extends rearward relative to a wall of the cam chamber cover, or head assembly, such that the oil separator chamber 140 may be segregated from the cam chamber 96 as will be described.

With continued reference to FIG. 8, the oil separator 118 generally comprises a descending chamber 142 and an ascending chamber 144 that are at least substantially separated from one another with a dividing wall 146. The dividing wall may extend the entire depth of the chambers 142, 144 such that the chambers are connected only at one location or may allow some selective cross-migration if desired. Preferably, the descending chamber 142 is connected to the ascending chamber at a lowermost portion of both. As illustrated in FIG. 9, the chambers 142, 144 have a reduced depth portion 148 at a lower portion just above the connection portion. This reduced depth section 148 increases the velocity of the gases through this portion of the chambers 142, 144 to aid in the removal of lubricant from the exhaust gases. As will be recognized, however, it is possible to practice the present invention without the reduction in depth.

The descending chamber 142 of the illustrated embodiment terminates at a sloping boss 150. The sloping boss extends downward toward the dividing wall and, in the illustrated embodiment, extends past the dividing wall such that it covers more than half of the lower extremity of the oil separator chamber 140. Preferably, the boss 150 extends the entire depth of the chamber 140 to contain the gas flow within the flow passage extending through the two chambers 142, 144.

The ascending chamber 144 of the illustrated embodiment includes at least one, but preferably more than one, rib 152. The illustrated ribs slope downward into the gas flow and extend approximately halfway across the ascending chamber 144. The ribs 152 may slope upward or downward to varying degrees. Additionally, the ribs may extend all the way across the chamber 144 in embodiments in which the ribs do not extend the full depth of the chamber 144. In such embodiments, a chevron-shaped rib may be employed. It is also anticipated that ribs may be positioned within the descending chamber 142. In such applications, it is preferable that more ribs are positioned in the ascending chamber 144 than in the descending chamber 142.

The illustrated ascending chamber 144 terminates in an output chamber 154. The output port 127 connects the output chamber 154 with the induction system, as described above.

Figure 10:
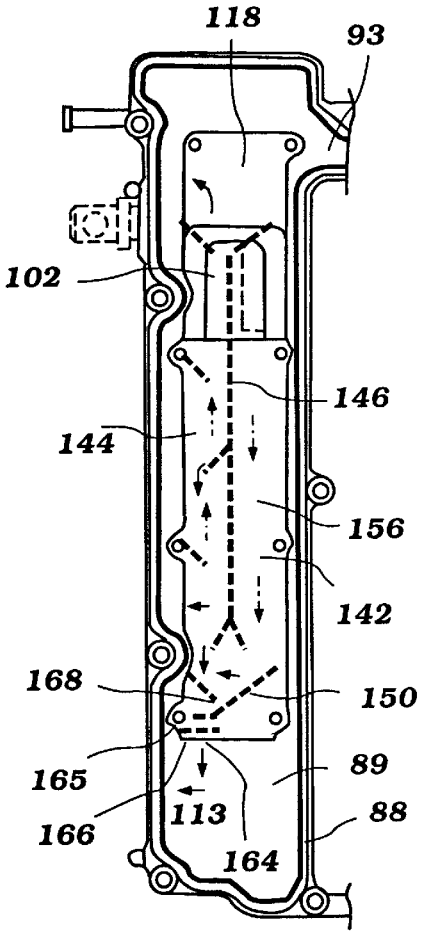
FIG. 10 is a portion of the head cover arrangement of FIGS. 8 and 9 with a cover plate of the illustrated oil separator assembled thereto.
Figure 11:
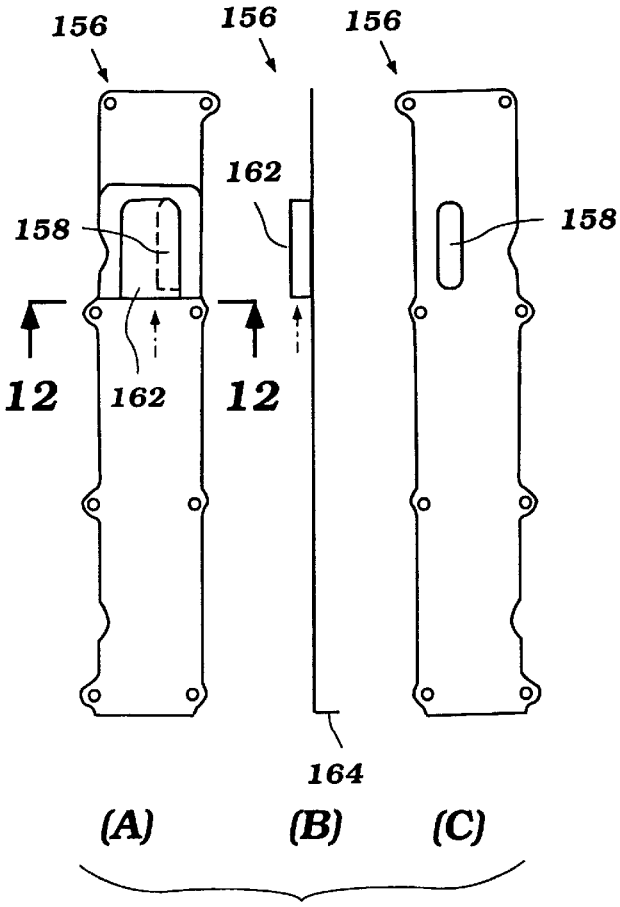
FIGS. 11(A) through 11(C) are three views of the cover plate of FIG. 10 illustrating a gas inlet portion configured and arranged in accordance with certain aspects of the present invention.

With reference now to FIGS. 10 and 11, a cover plate 156 extends over the oil separator chamber 140 and desirably segregates the oil separator chamber 140 from the cam chamber 96. The cover plate 156 thereby reduces the likelihood that lubricant will invade the oil separator chamber 140, such as by splashing or sloshing, from within the cam chamber 96 because of engine vibrations or rough operating conditions.

The illustrated cover plate 156 has a suction port 158 formed within an upper portion which is preferably positioned to open into the descending chamber 142 when the cover plate 156 is installed. The suction port 158 of the illustrated oil separator 118 is an oblong slot in shape; however, a variety of other shapes may also be used, such as, for instance, but without limitation, a circle, a square, an oval, a rectangle, a parallelogram, or an ellipse.

Figure 12:
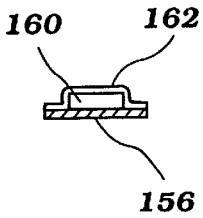
FIG. 12 is a cross-sectional view of the cover plate illustrated in FIG. 11(A) taken through the line 12—12.

With continued reference to FIGS. 11(A) through 11(C), the suction port 158 is positioned within an intake chamber 160 defined within an intake cover 162. In the illustrated embodiment, the intake cover 162 is a separate component that is attached in any suitable manner to the cover plate 156. In some embodiments, however, an integral member may form the intake chamber 160 and suction port 158 through an offsetting process or the like. Notably, as illustrated in FIG. 12, the opening into the chamber 160 extends upward such that the top of the illustrated chamber is at least partially shielded from ingesting lubricant which may be dripping downward over the cover plate 156.

Figure 13:
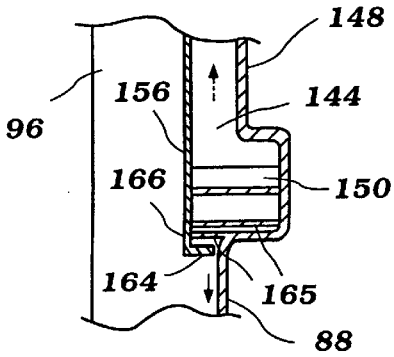
FIG. 13 is a partially sectioned view of the head cover arrangement and oil separator of FIG. 10 taken through the line 13—13.

With reference to FIGS. 10, 11(B) and 13, the cover plate 156 also includes a lip 164 positioned at or near its lower extremity. The lip 164 extends into the oil separator chamber 140 but allows an opening 166 to be positioned between the cover plate 156 and the wall of the cover 88. This opening 166 serves as an outlet for the lubricant separated from the exhaust gases and drained from the oil separator 118 into the cam chamber 96.

With reference to FIG. 10, such lubricant passes from the connecting portion between the descending chamber 142 and the ascending chamber 144 through an opening 168. The lubricant then passes across a distal portion of the boss 150 to the opening 166 in the illustrated embodiment. The opening 166 preferably extends through a second set of ribs 165, as illustrated. The illustrated structure preferably allows the oil to effectively dam the opening 166 against ingress from gases contained within the cam chamber 96 similar to a water trap. Of course, some aspects of the present invention may also be practiced without such a damming effect.

The illustrated oil separator 118 acts under the suction from the intake system. Exhaust blow-by gases are drawn from within the cam chamber 96 through the intake chamber 160. From the chamber 160, the gases are drawn through the restricting orifice formed by the intake opening 158 in the cover plate 156. The blow-by gases, with entrained lubricant, then are drawn downward through the descending chamber 156 into the connecting portion. The exhaust gases then ascend through the ascending chamber and encounter the ribs 150 that act to strain at least a portion of the lubricant from the gases prior to the gases entering the output chamber 154. The gases are then sucked through the output port 125 and passed to the induction system as described above. The lubricant extracted from the gases drains downward within the oil separator 118 and exits through the openings 168, 166 into the cam chamber 96.

The present oil separator is advantageously formed within a portion of the cam covers and does not require a separate sealing arrangement. The positioning of the oil separator chamber 140 within the cam covers allows for an integral construction of the oil separator and the head cover arrangement. Such a construction may reduce weight, material costs and assembly costs. Additionally, because a seal may not be necessary between the oil separator and the cam cover, maintenance costs may also be reduced.

Although the present invention has been described in terms of a certain embodiment, other embodiments apparent to those of ordinary skill in the art also are within the scope of this invention. Thus, various changes and modifications may be made without departing from the spirit and scope of the present invention. Moreover, not all the features, aspects and advantages are necessarily required to practice the present invention. Accordingly, the scope of the present invention is intended to be defined only by the claims that follow.

What is claimed is:

1. An outboard motor comprising an engine, the engine having a cylinder block, the cylinder block having at least one cylinder, the cylinder having a substantially horizontal axis, a piston arranged for reciprocation within the cylinder and connected to an output shaft, the output shaft having a substantially vertical axis, a head assembly connected to the cylinder block, at least one combustion chamber defined between the head assembly and a piston, at least one intake port and at least one exhaust port communicating with the combustion chamber, an intake valve capable of closing and opening the intake port, an exhaust valve capable of closing and opening the exhaust port, an intake cam shaft capable of moving the intake valves, an exhaust cam shaft capable of moving the exhaust valves, a head cover positioned over the intake cam shaft and the exhaust cam shaft and defining, in part, a cam chamber, an oil separator positioned within the cam chamber, a cover plate interposed between the oil separator and the cam chamber such that the oil separator may be separated from the cam chamber.

2. The outboard motor as set forth in claim 1 further comprising an induction system, wherein the oil separator is in communication with the induction system.

3. The outboard motor as set forth in claim 2 further comprising a gas conduit, wherein the oil separator is in direct communication with the induction system through the gas conduit.

4. The outboard motor as set forth in claim 2, wherein the oil separator further comprises a separator chamber and a suction port positioned in an upper portion of the oil separator, the suction port extending between the separator chamber and the cam chamber.

5. The outboard motor as set forth in claim 4, wherein the suction port is formed within an upper portion of the cover plate.

6. The outboard motor as set forth in claim 5, wherein the suction port extends into an intake chamber defined by an intake cover formed on the cam chamber side of the cover plate.

7. The outboard motor as set forth in claim 6, wherein the intake chamber has an inlet formed in a lower surface.

8. The outboard motor as set forth in claim 4, wherein the oil separator further comprises a generally unshaped flow path construction.

9. The outboard motor as set forth in claim 8, wherein the unshaped flow path construction generally comprises a descending chamber and an ascending chamber.

10. The outboard motor as set forth in claim 9, wherein the ascending chamber includes at least one rib.

11. The outboard motor as set forth in claim 9, wherein the ascending chamber has a first number of ribs and the descending chamber has a second number of ribs and the first number of ribs is greater than the second number of ribs.

12. An outboard motor comprising a generally vertically oriented engine, the engine comprising a generally vertically-oriented camshaft and crankshaft, a camshaft cover defining a camshaft chamber, the camshaft chamber substantially enveloping at least a portion of the camshaft, the engine also having an oil separator, a cover plate positioned between the oil separator and the camshaft chamber, the oil separator having a suction port defined with the cover plate, a shielding member defining an intake chamber and being positioned on the cam chamber side of the cover plate, the suction port extending in a first direction into the intake chamber, an opening defined within the shielding member that extends in a second direction not aligned with the first direction.

13. The outboard motor as set forth in claim 12, wherein the second direction is generally vertical.

14. The outboard motor as set forth in claim 12, wherein the camshaft cover includes a recess and the oil separator is positioned within the recess.

15. The outboard motor as set forth in claim 14, wherein the recess extends outward, away from the cam chamber.

16. The outboard motor as set forth in claim 12, wherein the suction port is defined within an upper portion of the cover plate.

17. The outboard motor as set forth in claim 16 further comprising an induction system, wherein the oil separator further comprises an outlet port, the outlet port being connected to the induction system and a flow path extends between the outlet port and the suction port.

18. The outboard motor as set forth in claim 17, wherein the flow path extends through a generally u-shaped labyrinth.

19. The outboard motor as set forth in claim 18, wherein the generally u-shaped labyrinth includes a trough portion and a lubricant outlet is positioned within the trough portion.

20. An outboard motor comprising an engine, the engine having a cylinder block, the cylinder block having at least one cylinder, the cylinder having a substantially horizontal axis, a piston arranged for reciprocation within the cylinder and connected to an output shaft, the output shaft having a substantially vertical axis, a head assembly connected to the cylinder block, at least one combustion chamber defined between the head assembly and the piston, at least one intake port and at least one exhaust port communicating with the combustion chamber, an intake valve capable of closing and opening the intake port, an exhaust valve capable of closing and opening the exhaust port, an intake cam shaft capable of moving the intake valve, an exhaust cam shaft capable of moving the exhaust valve, a cover positioned over the intake cam shaft and the exhaust cam shaft and partially defining a cam chamber which is divided into two substantially separate subchambers, an oil separator being disposed within at least one of the two subchambers, and a plate covering at least a portion of the oil separator such that at least a portion of an interior of the oil separator is segregated from the cam chamber.

21. The outboard motor as set forth in claim 20 further comprising an induction system, wherein the oil separator is in communication with the induction system.

22. The outboard motor as set forth in claim 21 further comprising a gas conduit, wherein the oil separator is in direct communication with the induction system through the gas conduit.

23. The outboard motor as set forth in claim 22, wherein the cover comprises an upper portion and a suction port is disposed in the upper portion.

24. The outboard motor as set forth in claim 20 further comprising a flow path that extends through a generally u-shaped labyrinth formed within the oil separator.

25. The outboard motor as set forth in claim 24, wherein the labyrinth includes a plurality of ribs.

26. The outboard motor as set forth in claim 24, wherein the labyrinth includes a lubricant outlet at its lowermost extremity.

27. The outboard motor as set forth in claim 24, wherein the oil separator further comprises an outlet port, the outlet port being disposed between the induction system and the labyrinth.

* * * * *